US011434794B2

(12) United States Patent
Greif et al.

(10) Patent No.: US 11,434,794 B2
(45) Date of Patent: Sep. 6, 2022

(54) EXHAUST SOUND ATTENUATION DEVICE

(71) Applicant: Caterpillar Inc., Deerfield, IL (US)

(72) Inventors: Andrew Greif, Geneva, IL (US); Subhro Nathak, Peoria, IL (US); Saad Hasan, Naperville, IL (US); Peter Xiao, Wuxi (CN); Joseph Bobchik, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 512 days.

(21) Appl. No.: 16/433,830

(22) Filed: Jun. 6, 2019

(65) Prior Publication Data

US 2020/0386132 A1 Dec. 10, 2020

(51) Int. Cl.
*F01N 1/02* (2006.01)
*F01N 1/06* (2006.01)
(Continued)

(52) U.S. Cl.
CPC ..... *F01N 1/02* (2013.01); *F01N 1/06* (2013.01); *F01N 13/14* (2013.01); *G10K 11/162* (2013.01);
(Continued)

(58) Field of Classification Search
CPC ... F01N 1/06; F01N 1/02; F01N 13/14; F01N 2210/02; F01N 2310/02; F01N 2470/02;
(Continued)

(56) References Cited

U.S. PATENT DOCUMENTS 3,103,256 A * 9/1963 Deremer ..... F01N 1/02 181/266
4,192,401 A * 3/1980 Deaver ..... F01N 1/02 181/266
(Continued)

FOREIGN PATENT DOCUMENTS

CN 106468197 A 3/2017
CN 104948267 B 3/2018
(Continued)

OTHER PUBLICATIONS

Examination Report dated Oct. 12, 2021 in Application No. GB2007944.8.
(Continued)

*Primary Examiner* — Forrest M Phillips
(74) *Attorney, Agent, or Firm* — von Briesen & Roper, s.c.

(57) ABSTRACT

An exhaust muffler for an internal combustion engine includes a housing. A plurality of partitions are disposed within the housing, defining a plurality of chambers. An inlet pipe and an outlet pipe are also disposed within the housing and both the inlet and outlet pipes include a perforated region. The perforated region permits fluid communication between the inlet pipe, outlet pipe and the plurality of chambers. To attenuate engine noise, the perforated regions of the inlet and outlet pipes are positioned at opposite ends of the housing, forcing the exhaust gas to pass through each of the plurality of partitions and chambers, thereby damping the sound waves with minimum effect on engine back
(Continued)

pressure levels. Alternatively, the perforated regions of the inlet and outlet pipes may be aligned in a cross-flow chamber.

20 Claims, 12 Drawing Sheets

(51) Int. Cl.
*F01N 13/14* (2010.01)
*G10K 11/172* (2006.01)
*G10K 11/162* (2006.01)

(52) U.S. Cl.
CPC ..... *G10K 11/172* (2013.01); *F01N 2210/02* (2013.01); *F01N 2310/02* (2013.01); *F01N 2470/02* (2013.01); *F01N 2470/24* (2013.01); *F01N 2490/15* (2013.01)

(58) Field of Classification Search
CPC ..... F01N 2470/24; F01N 2490/15; G10K 11/162; G10K 11/172
USPC ..... 181/251, 227
See application file for complete search history.

(56) References Cited

U.S. PATENT DOCUMENTS 4,359,135 A * 11/1982 Wagner ..... F01N 1/003 181/266
4,360,076 A 11/1982 Suyama
4,388,804 A 6/1983 Bushmeyer
4,673,058 A * 6/1987 Roberts ..... F01N 1/02 181/256
5,025,890 A * 6/1991 Hisashige ..... F01N 1/02 181/256
7,942,240 B2 * 5/2011 Olsen ..... F01N 13/1894 181/269
8,820,475 B2 9/2014 Pradhan
10,196,947 B2 2/2019 LeRoy
10,526,043 B2 * 1/2020 Finnie ..... B62J 99/00
2004/0238272 A1 * 12/2004 Wan ..... F01N 1/084 181/251
2010/0193284 A1 * 8/2010 Zheng ..... F01N 13/185 181/276
2013/0220732 A1 * 8/2013 Park ..... F01N 1/084 181/257
2014/0251720 A1 * 9/2014 Daniszewski ..... F01N 13/1888 181/256

FOREIGN PATENT DOCUMENTS

CN 105909343 B 2/2019
CN 109458242 A 3/2019
EP 0296270 A1 12/1988
WO 2012149537 11/2012

OTHER PUBLICATIONS

UK Search Report for Patent Appln. No. GB2201535, dated Feb. 17, 2022 (5 pgs).

* cited by examiner

EXHAUST SOUND ATTENUATION DEVICE

TECHNICAL FIELD

The present disclosure relates generally to sound attenuation devices for use with various types of engines, and, more specifically, the present disclosure relates to a muffler that is consistently effective over a broad range of frequencies and operating conditions.

BACKGROUND

Engines, including internal combustion engines and gas turbine engines, produce exhaust gases that must be vented from the engine system. Typically, the exhaust gases travel from the engine through an exhaust system before being expelled to the atmosphere. As the exhaust gases travel at high velocities through exhaust pipes and other system components, the gases produce noise emissions that can reach high decibel (dB) levels. In work machine applications, such as excavators, track type tractors, and the like, exhaust sounds can result in significant noise levels in an operator cab, which may be not only distracting, but also dangerous. It is well known that exposure to high decibel noise over extended periods of time can permanently damage an individual's hearing.

To reduce noise levels, exhaust systems typically include attenuation devices, such as mufflers. Currently, each machine type has its own unique exhaust system or muffler design, since machines typically have different operating conditions, engine speeds, sound testing points, engine back pressure restrictions, and other limitations. For example, current mufflers are typically tuned to a single frequency or a narrow range of frequencies, depending on the application. A typical muffler installed in a work machine, for instance, may utilize resonator chambers to help attenuate noise in the high frequency band. Enlarging resonator chambers, however, results in a larger muffler overall and may elevate a surface temperature of the muffler.

Utilizing an incorrect muffler design can directly affect engine performance. If the muffler design causes an increase in back pressure, and the resulting back pressure is too high, the "breathing ability" and subsequent performance of the engine could be negatively impacted. Generally, increased back pressure results in lower fuel efficiency, decreased performance, and even a limited altitude range for a given engine, among other disadvantages.

Prior attempts to improve muffler sound attenuation have been directed to various geometric arrangements for directing flow of exhaust gas through various chambers within the muffler housing. For example, U.S. Pat. No. 4,359,135 discloses a muffler that utilizes an input tube and an output tube, with solid partitions to create a number of chambers within the muffler housing. One partition, between a flow chamber and a large resonator chamber, includes two apertures, which permit a limited amount of exhaust gas to travel from the input tube to the large resonator chamber. The system also utilizes a conversion-divergent nozzle, which is installed in the exhaust output tube to reflect a portion of the sound waves attempting to enter the output tube back into the flow chamber.

Designing and producing a different muffler system for each machine application can be both expensive and time consuming. Sometimes, mufflers are not tuned well or their noise reduction capability drops with changes in operating conditions and temperatures. There is consequently a need for a compact, cost-efficient sound attenuation device that performs consistently at both low and high frequencies, over a broad range of operating conditions, and manages sound reduction and back pressure requirements for a broad range of machines.

SUMMARY

In accordance with one aspect of the present disclosure, an engine system is disclosed. The engine system may comprise an engine having at least one cylinder, each one having a combustion chamber, a piston, and an exhaust valve configured to release exhaust gases. The engine system may also include an exhaust system in fluid communication with the engine, including an exhaust pipe, as well as an exhaust muffler. The muffler may have a housing including an exterior wall, a concentric interior wall, a first end cap and a second end cap opposite the first end cap. Proximate the first end cap may be a first perforated end plate, and proximate the second end cap may be a second perforated end plate. Positioned between the first perforated end plate and the second perforated end plate may be a plurality of perforated baffles. The muffler may also include an inlet pipe in fluid communication with the exhaust pipe, and an outlet pipe. The inlet pipe may be disposed within the interior wall and extend through the first end cap, through the first end plate, and through the plurality of perforated baffles. A portion of the inlet pipe may be perforated. The outlet pipe may be disposed within the interior wall and extend through the second end cap, through the second end plate, and through the plurality of perforated baffles. A portion of the outlet pipe may also be perforated.

In accordance with another aspect of the present disclosure, an exhaust muffler for use with an internal combustion engine is disclosed. The exhaust muffler may comprise a housing including an exterior wall, a concentric interior wall, a first end cap and a second end cap opposite the first end cap. Disposed within the housing may be a plurality of partitions that may define a plurality of chambers. The muffler may also include an inlet pipe disposed within the interior wall and extending through the first end cap, through the plurality of partitions, and through the second end cap. A portion of the inlet pipe may be perforated. The muffler may further include an outlet pipe disposed within the interior wall and extending through the second end cap, through the plurality of partitions, and through the first end cap. A portion of the outlet pipe may be perforated.

In accordance with yet another aspect of the present disclosure, an exhaust muffler for an internal combustion engine is disclosed. The exhaust muffler may include a housing with an exterior wall, a concentric interior wall, a first end cap and a second end cap opposite the first end cap. Disposed within the housing may be a plurality of partitions, defining a plurality of chambers. The chambers may include a first resonator chamber proximate the first end cap, a second resonator chamber proximate the second end cap, and a cross-flow chamber positioned between the first resonator chamber and the second resonator chamber. An inlet pipe may be disposed within the interior wall and extend through the first end cap, through the first resonator chamber, through the cross-flow chamber and into the second resonator chamber. A portion of the inlet pipe within the cross-flow chamber may be perforated. An outlet pipe may be disposed within the interior wall and extend through the second end cap, through the second resonator chamber, through the cross-flow chamber and into the first resonator chamber. A portion of the outlet pipe within the cross-flow chamber may be perforated.

These and other aspects and features of the present disclosure will be better understood upon reading the following detailed description, when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
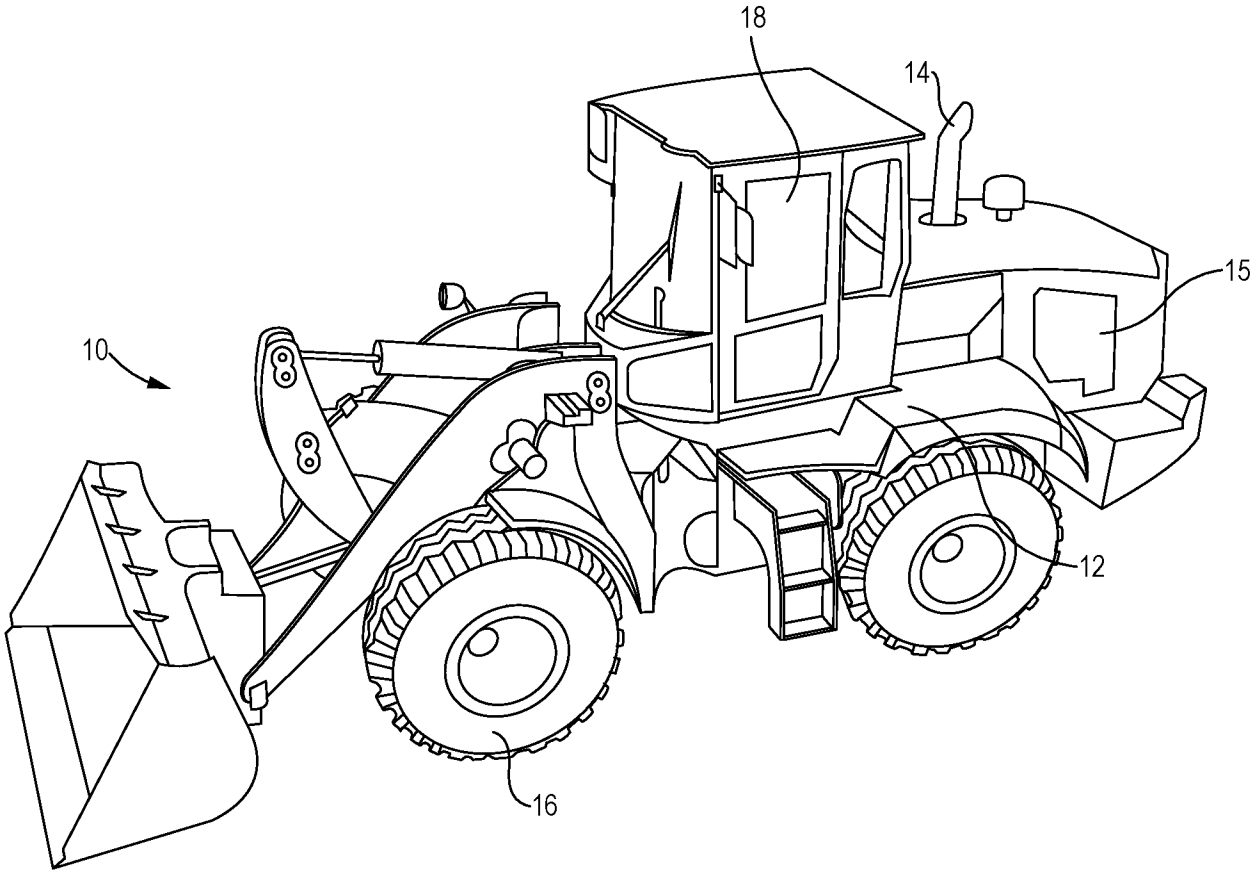
FIG. 1 is a side perspective view of a work machine having an exhaust muffler constructed in accordance with the present invention.

FIG. 1 illustrates a side perspective view of a work machine 10, according to an embodiment of the present disclosure. The exemplary work machine 10 may be a vehicle such as a wheel loader, although the features disclosed herein may be utilized with other types of machines, regardless of the type of work performed by the machine. The term "machine" includes vehicles or machines. The work machine 10 generally includes a chassis 12, an engine housing 15, an operator cab 18, and a plurality of wheels 16. The engine housing 15 may house an engine (not shown), aftertreatment systems, if any, and other machine components. An exhaust muffler 20 (FIG. 2) may be installed inside or outside the engine housing 15, depending on the type of machine and the arrangement of mechanical parts of the machine, among other factors. While the work machine 10 is illustrated with wheels 16, the present exhaust muffler 20 (FIG. 2) is compatible with both wheel-equipped and track-equipped work machines.

Figure 2:
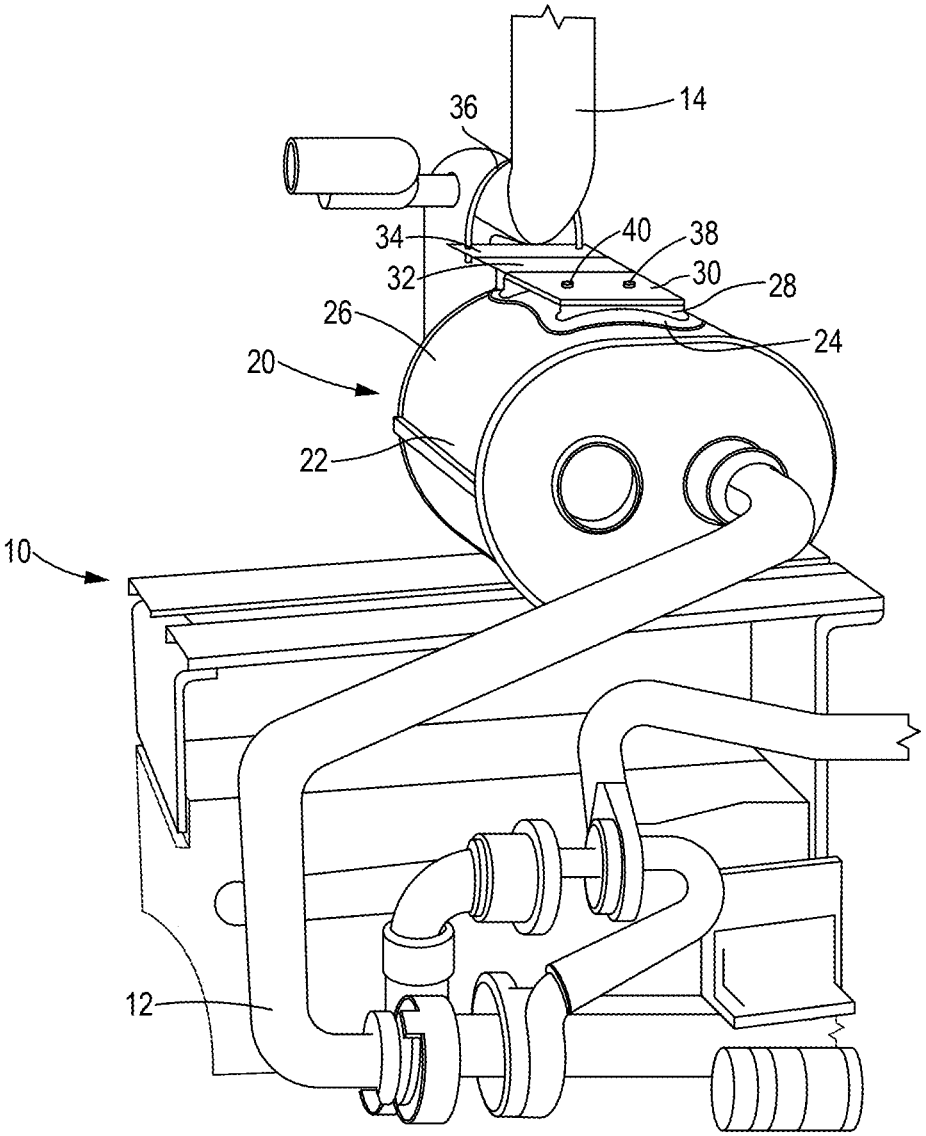
FIG. 2 is a perspective view of an exhaust muffler constructed in accordance with an embodiment of the present invention.
Figure 3:
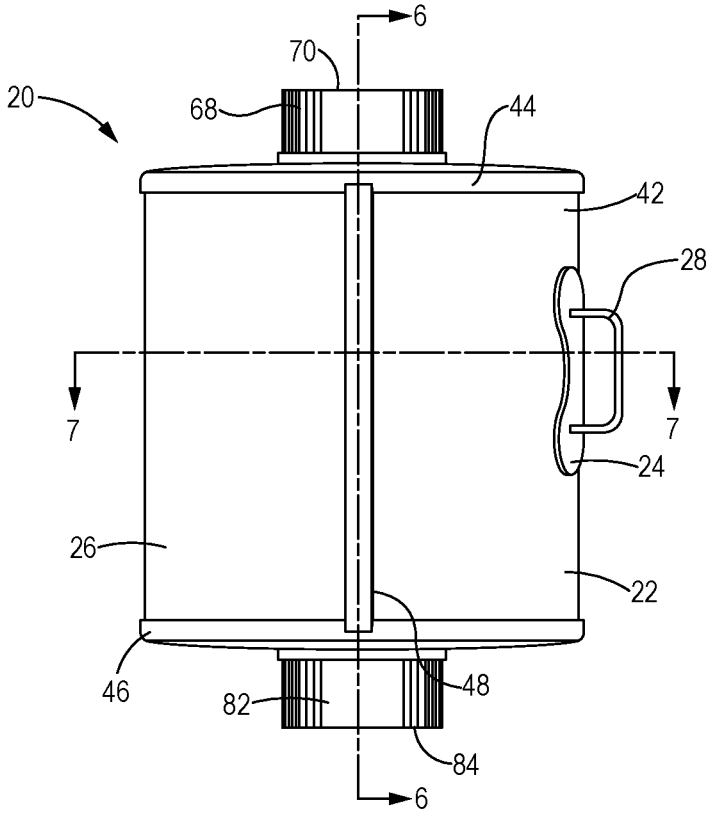
FIG. 3 is a side view of an exhaust muffler constructed in accordance with an embodiment of the present invention.
Figure 4:
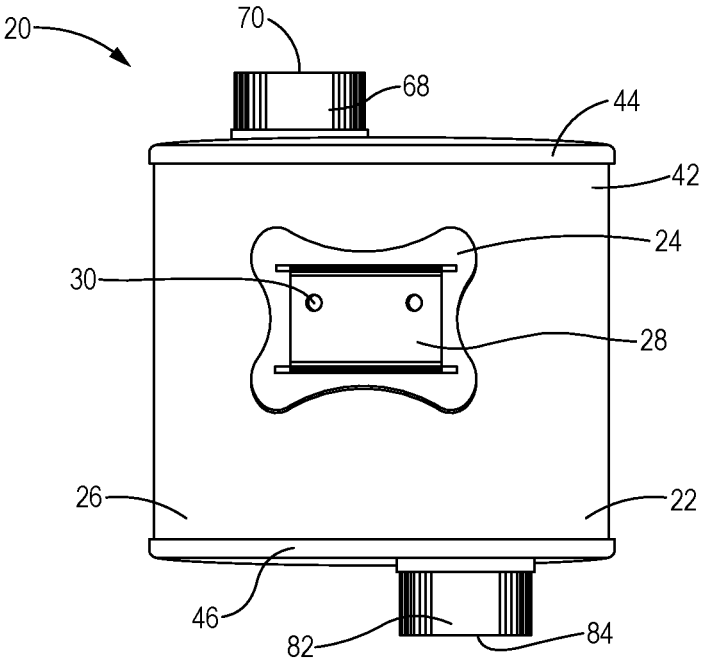
FIG. 4 is a side view of an exhaust muffler constructed in accordance with an embodiment of the present invention.
Figure 5:
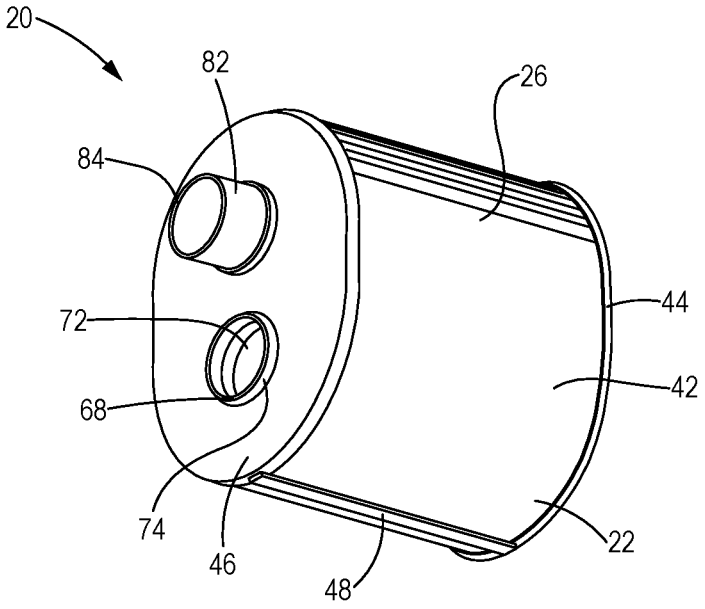
FIG. 5 is a perspective view of an exhaust muffler constructed in accordance with an embodiment of the present invention.

FIG. 2 illustrates an exemplary arrangement of the exhaust muffler 20 within the work machine 10, constructed according to an embodiment of the present disclosure. The exhaust muffler 20 is fluidly connected to an engine (not shown) via an exhaust pipe 13. The engine may be an internal combustion engine, such as a diesel engine, including one or more engine cylinders. Each engine cylinder may have a combustion chamber, a piston, and an exhaust valve for release of exhaust gases to the muffler 20. Combustion noise or sound waves may be generated by each cylinder as a result of oscillations by the piston through the cylinder. Engine noise and sound waves may also be generated by fuel supply systems, lubrication systems, starter systems, gearing systems, or other components of the engine system. When released via the exhaust valve (not shown), the exhaust gases and associated sound waves may pass through various components of the exhaust system, including an exhaust manifold, a catalytic converter, oxygen sensors, or other components that may clean the exhaust gases and attenuate the sound waves. The exhaust gases and sound waves travel through the exhaust pipe 13, as they progress toward the muffler 20. As the exhaust gases and sound waves pass through the muffler 20, the noise generated by the sound waves is diminished or attenuated. The exhaust gases exit the muffler 20 through an exhaust outlet pipe 14, and thereby may be released into the atmosphere.

The present muffler 20 may be generally cylindrical, flat oval, oval or rectangular in shape and includes a housing 22, which may be constructed from sound damping materials, ferrous or other metallic materials, or anti-corrosion materials. Example materials may include ferrous alloys, aluminum, aluminized steel, titanium alloys, and ceramics. Ferrous materials may be particularly resistant to the heat expelled by the engine system. Anti-corrosion materials may prevent rust or other corrosion, which may be caused by any combination of water, salt, or other environmental conditions placed on the engine system and muffler 20. Further, the housing 22 may be coated in a heat-resistant material, such as a heat-resistant paint.

A mounting base plate 24 may be fixed to an exterior surface 26 of the housing 22, for example, by welding, with adhesives, or by any other means that preserve the structural integrity of the housing. Fixed to the mounting base plate 24 is a mounting bracket 28 having a plurality of apertures 30. The mounting bracket 28 may be fixed to the mounting base plate 24, for example, by welding, with adhesives, or by any other means that preserve the structural integrity of the housing 22. The mounting bracket 28 may be dimensioned to allow for installation of a bracket 32, or other mechanism that supports or stabilizes a machine part installed in the engine system near the muffler 20. Supporting and stabilizing the machine part may not only reduce vibration of the machine part, but may also protect the muffler 20 from damage caused by excess vibrations or erratic movement of the machine (not shown). The exemplary arrangement in FIG. 2 illustrates a mounting bracket 32 that is z-shaped to secure the exhaust output pipe 14 to the muffler 20. More specifically, the exhaust output pipe 14 engages a top platform 34 of the bracket 32. A retaining band 36, or other retaining means, may secure the exhaust output pipe 14 to the top platform 34. A bottom platform 38 of the bracket 32 is secured to the mounting bracket 28 using fasteners 40 installed in the apertures 30. While other types of fasteners 40 may be used, bolts are preferred. For this reason, the mounting bracket 28 may be generally curved or arched, such that the apertures 30 are spaced apart from the exterior surface 26 of the housing 22. Spacing the apertures 30 apart from the exterior surface 26 of the housing 22 allows for installation of the fasteners 40 within the mounting bracket 28, while preserving the structural integrity of the housing.

Referring now to FIGS. 3-7, an exhaust muffler 20 is shown, constructed according to a first embodiment of the disclosure. The housing 22 of the muffler 20 may include an exterior wall 42, a first end cap 44 located at one end of the housing, and a second end cap 46 located at opposite the first end cap. The exterior wall 42 may be formed from a rigid material, such as aluminized steel, and may be coated in a heat-resistant material, such as a heat-resistant paint. A strip 48 of rigid material (e.g. steel, or other metal) may be used to reinforce weld seams or other construction seams, if any, in the housing 22. For example, the exterior wall 42 may be formed from a generally rectangular sheet of material by fixing (e.g. seam welding) opposing edges of the sheet together to form a generally cylindrical shape. The resulting seam may be reinforced by attaching the strip 48 of rigid material to the exterior wall 42 at the location of the seam.

Figure 6:
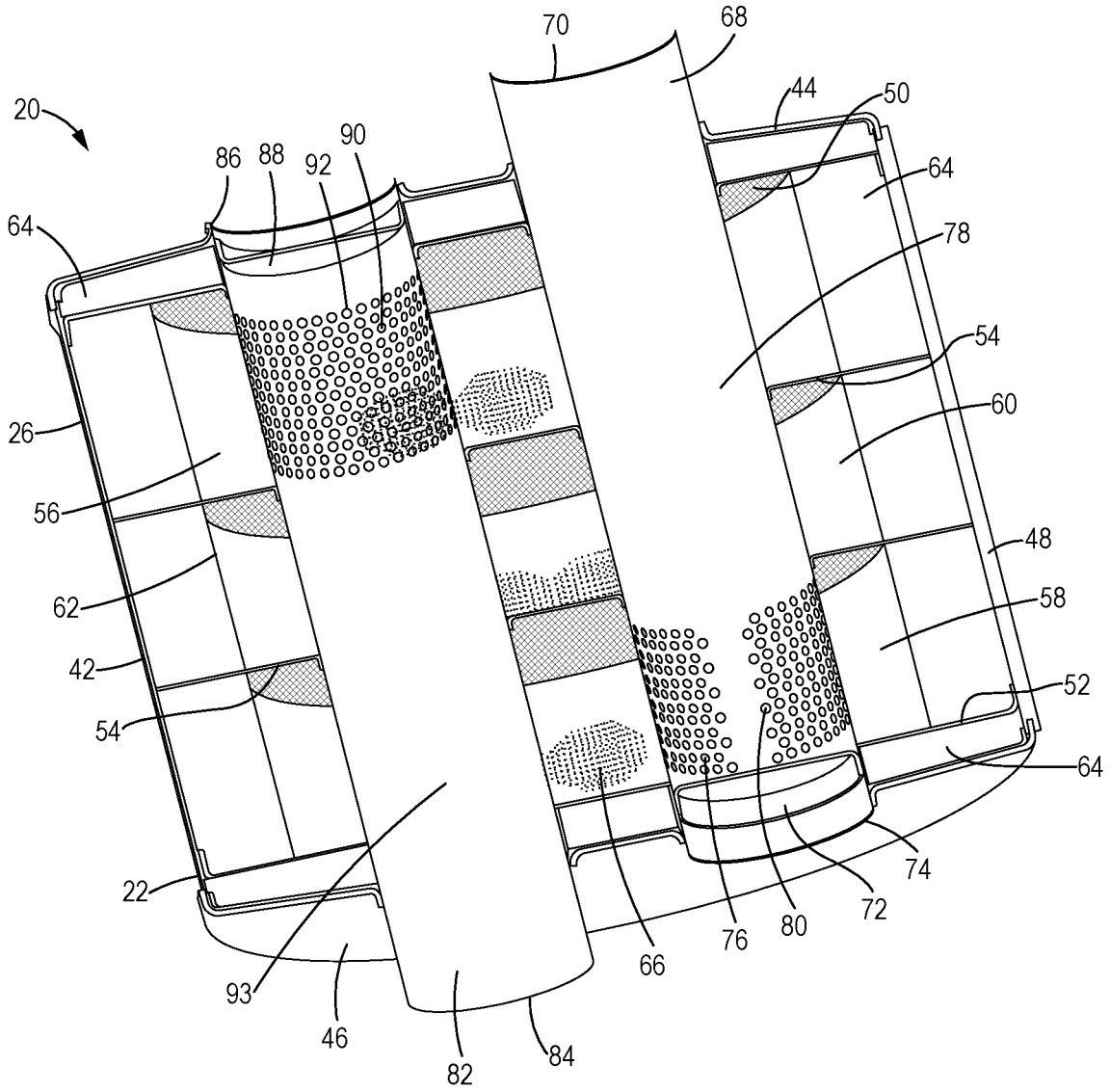
FIG. 6 is a perspective sectional view of an exhaust muffler constructed in accordance with the present disclosure, taken along the line 6-6 of FIG. 3 in the direction of the arrows.
Figure 7:
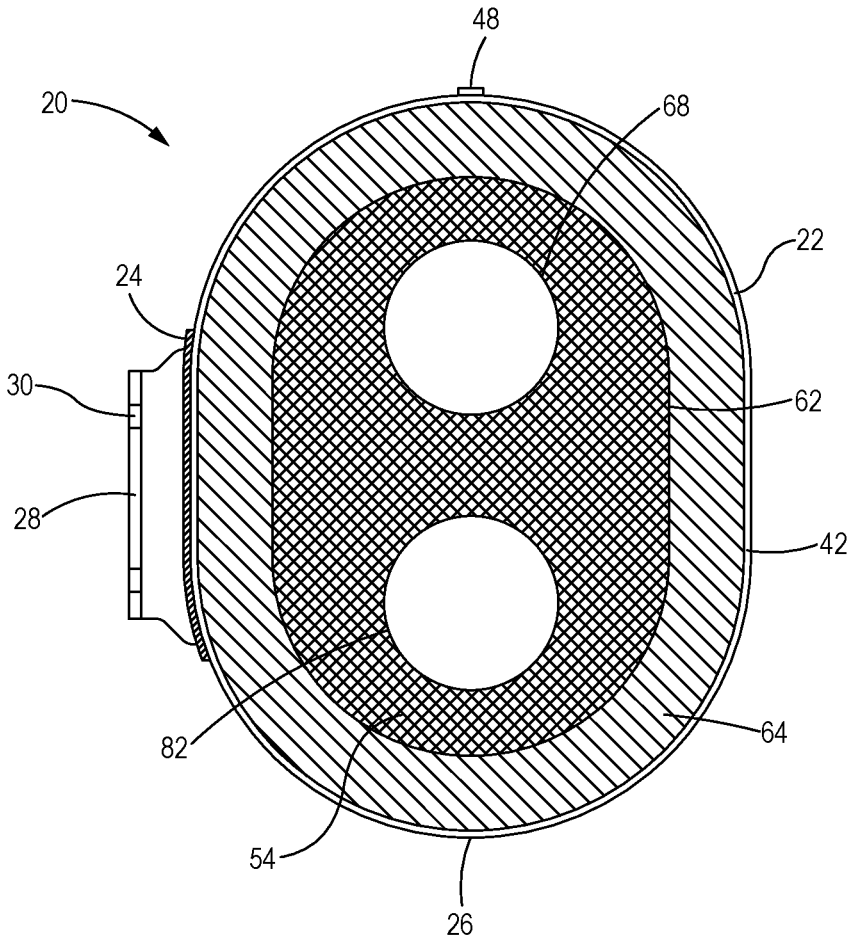
FIG. 7 is a perspective sectional view of an exhaust muffler constructed in accordance with the present disclosure, taken along the line 7-7 of FIG. 3 in the direction of the arrows.

Referring to FIGS. 6 and 7, the muffler 20 may include a plurality of partitions 50, 52, 54, which divide the interior of the housing 22 into a plurality of chambers 56, 58, 60. More specifically, the plurality of partitions may include a perforated first end plate 50, which may be positioned proximate the first end cap 44, and a perforated second end plate 52, which may be positioned proximate the second end cap 46. Positioned between the first end plate 50 and the second end plate 52 may be a plurality of perforated baffle plates 54. The plurality of chambers 56, 58, 60 may include a first chamber 56 defined by the space between the first end plate 50 and one of the perforated baffle plates 54, a second chamber 58 defined by the space between the second end plate 52 and one of the perforated baffle plates 54, and a middle chamber 60 defined by the space between the first chamber and the second chamber. While other arrangements may be contemplated, the plurality of partitions 50, 52, 54 may be evenly spaced laterally within the housing 22, such that the volume of each of chamber 56, 58, 60 is similar or equal.

The end plates 50, 52 and the baffle plates 54 may be dimensioned to fit within an interior wall 62, which may be disposed within the housing 22. Insulation material 64 may be installed or packed between the interior wall 62 and the exterior wall 42, to provide thermal insulation and additional sound attenuation within the muffler 20. Insulation material 64 may also be installed or packed between the first end plate 50 and the first end cap 44, as well as between the second end plate 52 and the second end cap 46. The insulation material 64 may be formed from one or a combination of sound and heat absorbing materials, such as fiberglass, or other fibrous material. The interior wall 62 may contain perforated regions 66, or its entire surface may be perforated, to encourage sound attenuation and heat absorption. Typical small or compact mufflers require use of a heat shield disposed within or around the body of the muffler, since they typically include little-to-no insulating material. The present muffler 20, however, utilizes a layer of insulation material 64 that is thick enough to negate the need for a heat shield or other heat barrier. The thickness of the insulation material 64 may be approximately 2 inches. Other thicknesses, however, are also contemplated.

The muffler 20 may also include an inlet pipe 68, disposed within the housing 22, and configured for fluid communication with the exhaust pipe 13 of the exhaust system, such that exhaust gases and sound waves are directed through the muffler. More specifically, the inlet pipe 68 includes an inlet 70, through which the exhaust gases and sound waves enter the muffler 20. The inlet pipe 68 may be positioned within the interior wall 62, and may extend through the first end cap 44, through each of the plurality of partitions 50, 52, 54 and chambers 56, 58, 60, and through the second end cap 46. More specifically, an end 74 of the inlet pipe 68 opposite the inlet 70 may extend beyond the exterior surface 26 of the housing 22. An inlet plug member 72 may be inserted in the end 74 of the inlet pipe 68 to seal the end of the inlet pipe, and to prevent flow of the exhaust gas from the inlet pipe to the atmosphere. The inlet plug member 72 may be positioned such that it is radially aligned with the layer of insulation material 64 installed between the second end plate 52 and the second end cap 46.

With specific reference to FIG. 6, a portion or region 76 of the inlet pipe 68 may be perforated to direct the flow of the exhaust gases and sound waves within the muffler 20. The perforations 80 may be evenly spaced and extend circumferentially around the inlet pipe 68. The perforations 80 are shown in FIG. 6 as evenly spaced round holes or perforations. Other shapes and orientations may also be acceptable, including slits, circumferentially or helically oriented slots, or any other configuration found to be acceptable. While the inlet pipe 68 may be disposed through each of the plurality of chambers 56, 58, 60, the perforated portion 76 may be positioned to be in fluid communication with the second chamber 58. The inlet pipe 68 may further include a solid connective portion 78 that may extend through the first chamber 56 and the middle chamber 60, thereby fluidly isolating the inlet pipe from the first and middle chambers.

The muffler 20 of the present disclosure may further include an outlet pipe 82 (FIGS. 3-7), disposed within the interior wall 62 of the muffler 20 and configured for fluid communication with the exhaust output pipe 14, such that the exhaust gases and sound waves are directed out of the muffler. As shown in FIGS. 3, 5, 6 and 7, the outlet pipe 82 may be aligned with the inlet pipe 68, such that the inlet pipe and outlet pipe are generally parallel and planar to each other. Further, the inlet pipe 68 and the outlet pipe 82 may have the same diameter. Preferably, the inlet pipe 68 and outlet pipe 82 may have a diameter of approximately 4 inches. Similarly, the length of the inlet pipe 68, measured from the inlet 70 to the opposite plugged end 74 of the inlet pipe, and the length of the outlet pipe 82, measured from an outlet 84 to an opposite plugged end 86 of the outlet pipe, may be the same. This arrangement permits the inlet pipe 68 and the outlet pipe 82 to be interchanged, resulting in a muffler 20 that is reversible during installation.

The outlet pipe 82 may include the outlet 84, through which the exhaust gases and sound waves exit the muffler 20. The outlet pipe 82 may extend through the second end cap 46, through each of the plurality of partitions 50, 52, 54 and chambers 56, 58, 60, and through the first end cap 44. More specifically, the end 86 of the outlet pipe 82 opposite the outlet 84 may extend beyond the exterior surface 26 of the housing 22. An outlet plug member 88 may be inserted in the end 86 of the outlet pipe 82 to seal the outlet pipe, and to prevent flow of the exhaust gas from the end 86 of the outlet pipe to the atmosphere. The plug member 88 may be positioned such that it is radially aligned with the layer of insulation material 64 installed between the first end plate 50 and the first end cap 44.

With specific reference to FIG. 6, a portion or region 90 of the outlet pipe 82 may be perforated to direct the flow of the exhaust gases and sound waves within the muffler 20.

The perforations 92 may be evenly spaced and extend circumferentially around the region 90 of the outlet pipe 82. The perforations 92 are shown in FIG. 6 as evenly spaced round holes or perforations. Other shapes and orientations may also be acceptable, including slits, circumferentially or helically oriented slots, or any other configuration found to be acceptable. While the outlet pipe 82 may be disposed through each of the plurality of chambers 56, 58, 60, the perforated region 90 may be positioned to be in fluid communication with the first chamber 56. The outlet pipe 82 may further include a solid connective portion 93 that may extend through the second chamber 58 and the middle chamber 60, thereby fluidly isolating the outlet pipe from the second and middle chambers.

Another embodiment of the present muffler 20 is shown in FIGS. 8-12. As in the previous embodiment, the muffler 20 may include a plurality of partitions 50, 52, 122, which divide the interior of the housing 22 into a plurality of chambers 94, 96, 98. More specifically, the plurality of partitions may include a perforated first end plate 50, which may be positioned proximate the first end cap 44, and a perforated second end plate 52, which may be positioned proximate the second end cap 46. Positioned between the first end plate 50 and the second end plate 52 may be a plurality of baffle plates 122. With specific reference to FIGS. 11 and 12, the plurality of chambers 94, 96, 98 may include a first resonator 94 defined by the first end plate 50 and one of the baffle plates 122, a second resonator 96 defined by the second end plate 52 and one of the baffle plates 122, and a cross-flow chamber 98 defined between the plurality of baffle plates 122. While other arrangements may be contemplated, in this embodiment, the plurality of baffle plates 122 may be irregularly spaced within the housing 22, such that the volume of one resonator is larger than the other resonator. In addition, the baffle plates 122 may be solid in order to direct exhaust gases and sound waves toward the resonator chambers 94, 96.

As shown in FIGS. 8-12, the muffler 20 may include an inlet pipe 100. As in the previous embodiment, the inlet pipe 100 may be disposed within the housing 22, and configured for fluid communication with the exhaust pipe 13 of the exhaust system, such that exhaust gases and sound waves are directed through the muffler. Similarly, the inlet pipe 100 is configured with an inlet 102, through which the exhaust gases and sound waves enter the muffler 20. As shown more specifically in FIGS. 11 and 12, the inlet pipe 100 may be positioned within the interior wall 62, and may extend through the first end cap 44, through the first end plate 50, and through each of the plurality of baffle plates 122, into the second resonator chamber 96. An open end 104 of the inlet pipe 100 opposite the inlet 102 may extend into the second resonator chamber 96.

Figure 11:
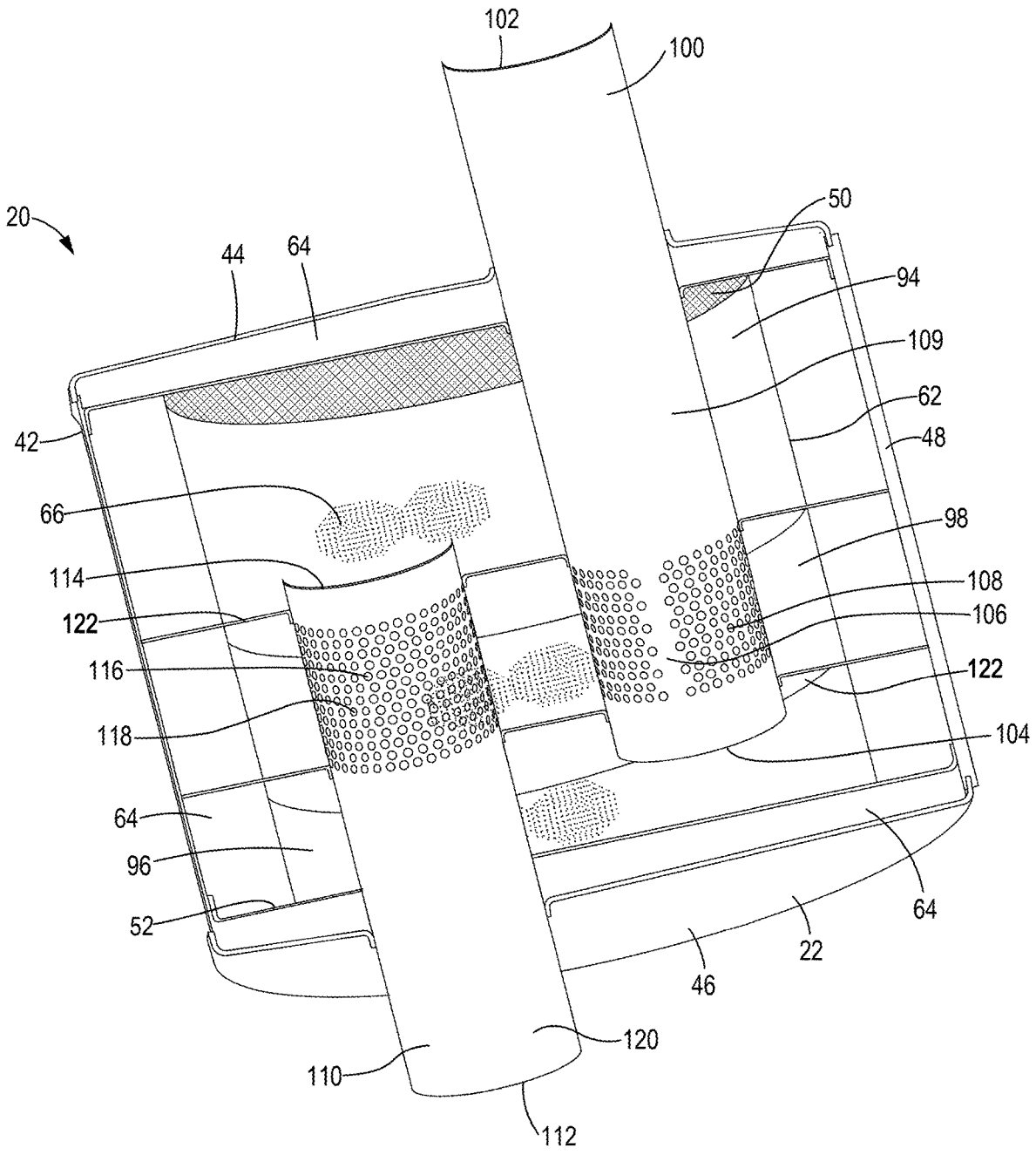
FIG. 11 is a perspective sectional view of an exhaust muffler constructed in accordance with the present disclosure, taken along the line 11-11 of FIG. 8 in the direction of the arrows.

As illustrated in FIG. 11, a portion or region 106 of the inlet pipe 100 disposed within the cross-flow chamber 98 may be perforated to provide fluid communication between the inlet pipe and the cross-flow chamber. The perforations 108 may be spaced evenly and extend circumferentially around the perforated region 106 of the inlet pipe 100. The perforations 108 are shown in FIG. 11 as evenly spaced round holes or perforations, however, other shapes and orientations may also be acceptable including slits, circumferentially or helically oriented slots, or any other configuration found to be acceptable. While the inlet pipe 100 may be disposed through each of the plurality of chambers 94, 96, 98, the perforated region 106 may be positioned to be in fluid communication with the cross-flow chamber 98. The inlet pipe 100 may further include a solid connective portion 109 that may extend through the first resonator 94, thereby fluidly isolating the inlet pipe from the first resonator.

Figure 8:
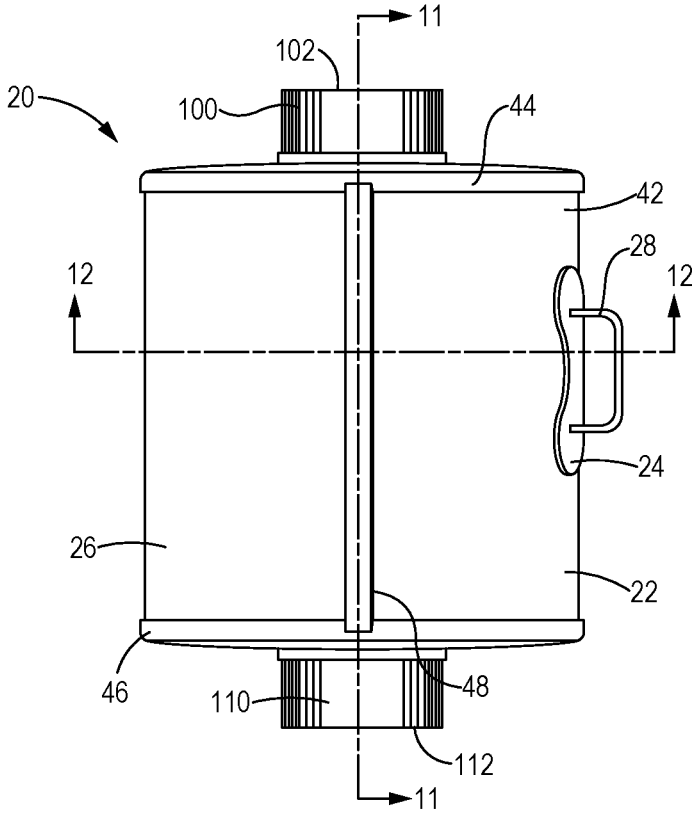
FIG. 8 is a side view of an exhaust muffler constructed in accordance with an embodiment of the present invention.
Figure 9:
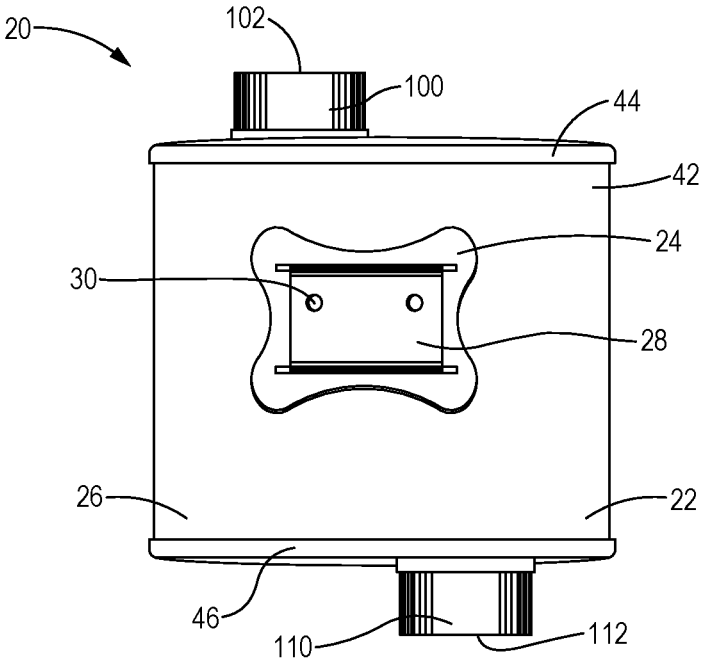
FIG. 9 is a side view of an exhaust muffler constructed in accordance with an embodiment of the present invention.
Figure 10:
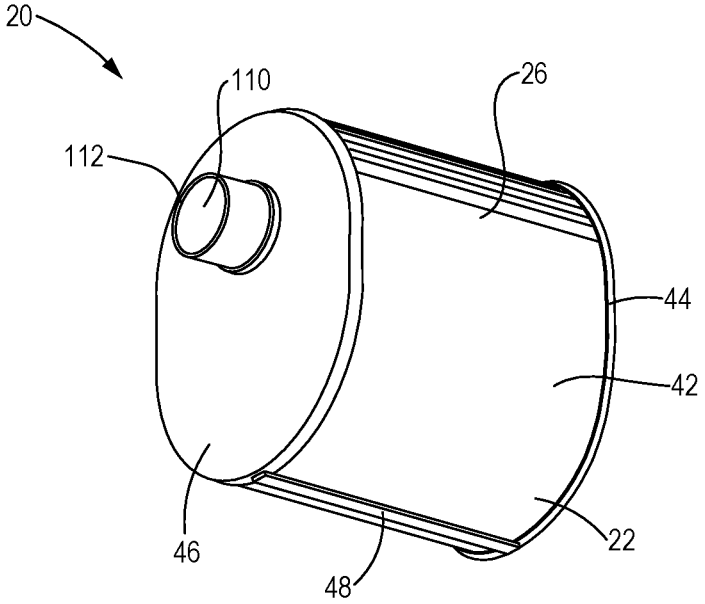
FIG. 10 is a perspective view of an exhaust muffler constructed in accordance with an embodiment of the present invention.
Figure 12:
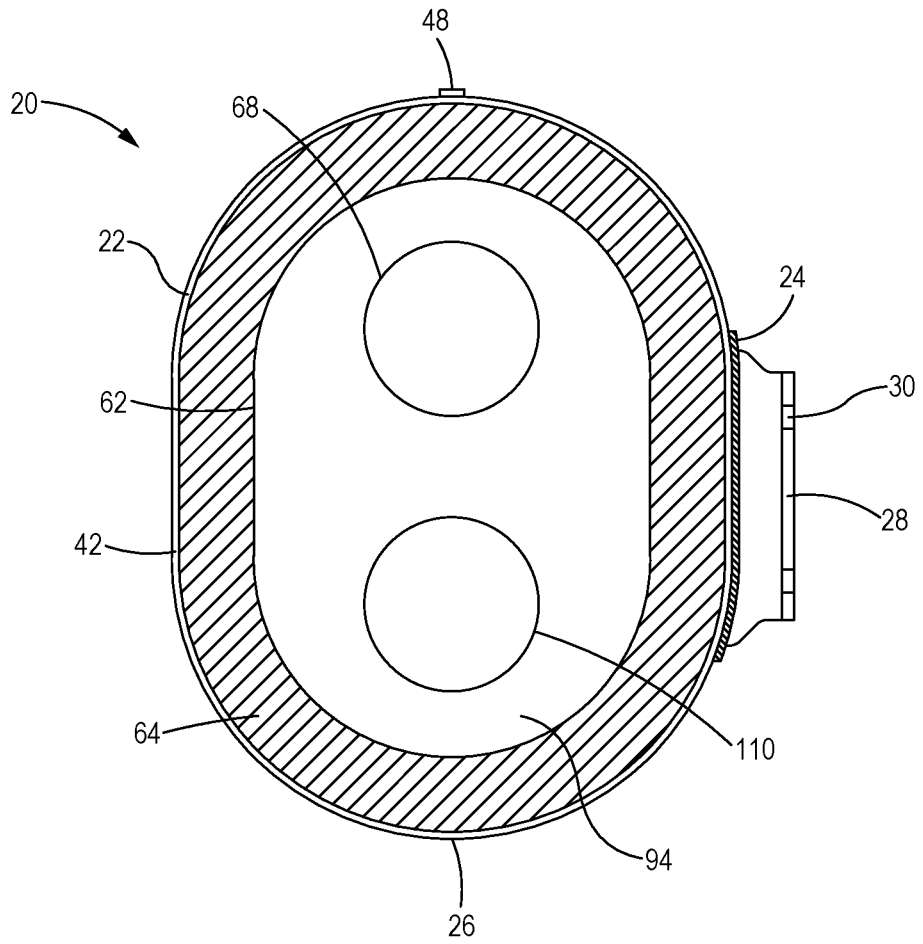
FIG. 12 is a perspective sectional view of an exhaust muffler constructed in accordance with the present disclosure, taken along the line 12-12 of FIG. 8 in the direction of the arrows.

The muffler 20 of the present disclosure may further include an outlet pipe 110 (FIGS. 8-12), disposed within the interior wall 62 of the muffler 20 and configured for fluid communication with the exhaust output pipe 14, such that the exhaust gases and sound waves are directed out of the muffler. As shown in FIGS. 8, 11 and 12, the outlet pipe 110 may be aligned with the inlet pipe 100, such that the inlet pipe and the outlet pipe are generally parallel and planar to each other. Further, the inlet pipe 100 and the outlet pipe 110 may have the same diameter. Preferably, the inlet pipe 100 and outlet pipe 82 may have a diameter of approximately 5 inches. Similarly, the length of the inlet pipe 100, measured from the inlet 102 to the opposite open end 104 of the inlet pipe, and the length of the outlet pipe 110, measured from an outlet 112 to an opposite open end 114 of the outlet pipe, may be the same. This arrangement permits the inlet pipe 100 and the outlet pipe 110 to be interchanged, resulting in a muffler 20 that is reversible during installation.

The outlet pipe 110 may include the outlet 112, through which the exhaust gases and sound waves exit the muffler 20. The outlet pipe 110 may be positioned within the interior wall 62, and may extend through the second end cap 46, through the second end plate 52, and through each of the plurality of baffle plates 122, into the first resonator chamber 94. The open end 114 of the outlet pipe 110 opposite the outlet 112 may extend into the first resonator chamber 94. As illustrated in FIG. 11, a portion or region 116 of the outlet pipe 110 disposed within the cross-flow chamber 98 may be perforated to provide fluid communication between the outlet pipe and the cross-flow chamber. The perforations 118 may be spaced evenly and extend circumferentially around the perforated region 116 of the outlet pipe 110. The perforations 118 are illustrated in FIG. 11 as evenly spaced round holes or perforations. Other shapes and orientations may also be acceptable including slits, circumferentially or helically oriented slots, or any other configuration found to be acceptable. While the outlet pipe 110 may be disposed through each of the plurality of chambers 94, 96, 98, the perforated region 116 may be positioned to be in fluid communication with the cross-flow chamber 98. The outlet pipe 110 may further include a solid connective portion 120 that may extend through the second resonator 96, thereby fluidly isolating the outlet pipe from the second resonator.

INDUSTRIAL APPLICABILITY

In practice, the teachings of the present disclosure may find applicability in many industries including, but not limited to, construction and earth moving equipment. For example, the present disclosure may be beneficial to medium wheel loaders, motor graders, track-types tractors, and other machines with diesel engine systems. The present disclosure provides an exhaust muffler with interchangeable inlet and outlet pipes, insulation material for thermal insulation and high frequency attenuation, reduced back pressure, and overall noise attenuation in both low frequency and mid-high frequency broadband flow noise, which is enhanced compared to previous mufflers designed for these applications throughout the industry.

Internal combustion engines provide power to various machines, such as, but not limited to, earth moving equipment, on-highway trucks or vehicles, off-highway trucks or machines, locomotives, generators, pumps, and other mobile and stationary applications. During operation, an internal combustion engine produces sound waves from the repeated opening of exhaust valves and the expulsion of exhaust gases as the sound waves propagate through the exhaust gas flow. The muffler 20 of the present disclosure is configured to reduce noise at both high and low frequencies and fulfill back pressure requirements from different machine applications with similar engine applications. It has been designed such that it will perform consistently over a broad frequency range, and, for example, handle various engine frequency firing orders. The present muffler 20 is also compatible with machines that have no aftertreatment system, as well as those that have an aftertreatment system. For example, the muffler 20 of the present disclosure may be installed onto a preexisting exhaust system to add additional sound attenuation, if necessary. This situation may be most applicable if the machine is located in a country that regulates exhaust noise levels (e.g. the United States, Australia, European countries) in order to comply with changing regulations.

In accordance with a first embodiment of the present disclosure, the inlet pipe 68 of the muffler 20 may be coupled to the exhaust pipe 13 of an internal combustion engine (not shown). The flow of exhaust gas may be directed through the inlet pipe 68. When the flow of exhaust gas impacts the inlet plug member 72, the exhaust gas and sound waves are dispersed through the perforated portion 76 of the inlet pipe into the second chamber 58. Some sound waves may be absorbed by the insulation material 64 through the perforated regions 66 of the interior wall 62 and the perforated second end plate 52, while other sound waves may be reflected and cancelled, thereby allowing for sound attenuation.

The exhaust gas flow continues from the second chamber 58 through the perforated baffle plates 54 and middle chamber 60 and into the first chamber 56. Sound waves continuing to propagate within the exhaust gas flow may be absorbed by the insulation material 64 through the perforated regions 66 of the interior wall 62 and through the perforated first end plate 50, or may be scattered and undergo further reflection and cancelling in the first chamber 56 or the middle chamber 60. Finally, the exhaust gas flow may enter the outlet pipe 82 through the perforations 92 in the perforated region 90. The exhaust gas and sound waves, now trapped within the solid connective portion 93 of the outlet pipe 82, exits the muffler 20 to the atmosphere via the exhaust output pipe 14. In this embodiment, the perforated region 76 of the inlet pipe 68 may be positioned at an end of the muffler that is opposite the perforated region 90 of the outlet pipe 82. This arrangement creates a long, tortious path for the exhaust gas and sound waves, which enables dissipation of the sound waves, thereby maximizing sound attenuation.

In accordance with another embodiment of the present disclosure, the inlet pipe 100 of the muffler 20 is coupled to the exhaust pipe 13 of an internal combustion engine (not shown). The flow of exhaust gas is directed through the inlet pipe 100. As the flow of exhaust gas reaches the open end 104 of inlet pipe 100, a majority of the exhaust gas and sound waves are dispersed through the perforated region 106 of the inlet pipe into the cross-flow chamber 98, and directly into the outlet pipe 110 via the perforations 118 in the perforated region 116 of the outlet pipe. The sound waves continue into the second resonator 96, where some sound waves are absorbed by the insulation material 64 through the perforated regions 66 of the interior wall 62 and the perforated second end plate 52, and other sound waves are reflected and cancelled thereby allowing for sound attenuation. Exhaust gas and any remaining sound waves that enter the outlet pipe 110 through the perforations 118 in the perforated region 116 of the outlet pipe is forced toward the outlet 112, and exits the muffler 20 to the atmosphere via the exhaust output pipe 14. In this embodiment, the perforated region 106 of the inlet pipe 100 may be positioned within the same chamber 98 as the perforated region 116 of the outlet pipe 110, but the open end 104 of the inlet pipe 100 may be in fluid communication with the second resonator 96, and the open end 114 of the outlet pipe 110 may be in fluid communication with the first resonator 94. With the first resonator 94 being larger in volume than the second resonator 96, and with both resonators being positioned proximate each other, sound attenuation of resonant low frequencies is achieved.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. An exhaust muffler for an internal combustion engine, comprising:

a housing including an exterior wall, a concentric interior wall, a first end cap and a second end cap opposite the first end cap;

a plurality of partitions disposed within the housing defining a plurality of chambers, the plurality of partitions including a perforated first end plate disposed proximate to the first end cap, a perforated second end plate disposed proximate to the second end cap, and a plurality of baffles disposed between the perforated first end plate and the perforated second end plate;

a first insulation material disposed between the first end cap and the perforated first end plate, the first insulation material adjacent to the perforated first end plate and adjacent to the first end cap;

an inlet pipe disposed within the interior wall and extending through the first end cap, through the plurality of partitions, through the plurality of chambers, and through the second end cap, a portion of the inlet pipe being perforated; and an outlet pipe disposed within the interior wall and extending through the second end cap, through the plurality of partitions, through the plurality of chambers, and through the first end cap, a portion of the outlet pipe being perforated.

2. The exhaust muffler of claim 1, further including an inlet plug installed in the inlet pipe proximate the second end cap, and an outlet plug installed in the outlet pipe proximate the first end cap.

3. The exhaust muffler of claim 2, wherein the perforated portion of the inlet pipe is located proximate the inlet plug and the perforated portion of the outlet pipe is located proximate the outlet plug.

4. The exhaust muffler of claim 1, wherein at least one of the plurality of baffles located between the first end plate and the second end plate is perforated.

5. The exhaust muffler of claim 4, wherein a second insulation material is disposed between the second end plate and the second end cap, and a third insulation material is disposed between the interior wall and the exterior wall.

6. The exhaust muffler of claim 1, wherein the first insulation material is comprised of fiberglass.

7. The exhaust muffler of claim 5, wherein each of the plurality of partitions is dimensioned to fit within the exterior wall, such that each of the plurality of partitions extends radially through the interior wall and the third insulation material.

8. The exhaust muffler of claim 1, wherein a length of the inlet pipe and a length of the outlet pipe are equivalent, and the inlet pipe and outlet pipe are arranged parallel and planar to each other.

9. An exhaust muffler for an internal combustion engine, comprising:

a housing including an exterior wall, a concentric interior wall, a first end cap and a second end cap opposite the first end cap;

a plurality of partitions disposed within the housing and defining a plurality of chambers including at least a first resonator chamber proximate to the first end cap, a second resonator chamber proximate to the second end cap, and a cross-flow chamber positioned between the first resonator chamber and the second resonator chamber, the plurality of partitions including a perforated first end plate disposed proximate to the first end cap, a perforated second end plate disposed proximate to the second end cap, and a plurality of baffles disposed between the perforated first end plate and the perforated second end plate;

a first insulation material disposed between the first end cap and the perforated first end plate, the first insulation material adjacent to the perforated first end plate and adjacent to the first end cap;

an inlet pipe disposed within the interior wall and extending through the first end cap, through the first resonator chamber, through the cross-flow chamber and into the second resonator chamber, a portion of the inlet pipe disposed within the cross-flow chamber being perforated; and an outlet pipe disposed within the interior wall and extending through the second end cap, through the second resonator chamber, through the cross-flow chamber and into the first resonator chamber, a portion of the outlet pipe disposed within the cross-flow chamber being perforated.

10. The exhaust muffler of claim 9, wherein portions of the inlet pipe and the outlet pipe disposed within the first resonator chamber and the second resonator chamber are solid.

11. The exhaust muffler of claim 9, wherein the cross-flow chamber is positioned proximate the second end cap, such that a volume of the first resonator chamber is larger than a volume of the second resonator chamber.

12. The exhaust muffler of claim 9, wherein the plurality of baffles includes a first solid baffle separating the first resonator chamber and the cross-flow chamber, and a second solid baffle separating the second resonator chamber and the cross-flow chamber.

13. The exhaust muffler of claim 12, wherein a second insulation material is disposed between the second end plate and the second end cap, and a third insulation material is disposed between the interior wall and the exterior wall.

14. The exhaust muffler of claim 9, wherein the first insulation material is comprised of fiberglass.

15. The exhaust muffler of claim 13, wherein each of the plurality of partitions is dimensioned to fit within the exterior wall, such that each of the plurality of partitions extends radially through the interior wall and the third insulation material.

16. The exhaust muffler of claim 9, wherein a length of the inlet pipe and a length of the outlet pipe are equivalent, and the inlet pipe and the outlet pipe are arranged parallel and planar to each other.

17. An engine system, the engine system comprising:

an engine having at least one engine cylinder, each engine cylinder having a combustion chamber, a piston, and an exhaust valve for release of exhaust gases; and an exhaust system in fluid communication with the engine, the exhaust system including an exhaust pipe and an exhaust muffler, the exhaust muffler including a housing including an exterior wall, a concentric interior wall, a first end cap and a second end cap opposite the first end cap;

a first perforated end plate proximate to the first end cap;

a second perforated end plate proximate to the second end cap;

a plurality of baffles positioned between the first perforated end plate and the second perforated end plate;

a first insulation material disposed between the first end cap and the perforated first end plate, the first insulation material adjacent to the perforated first end plate and adjacent to the first end cap;

an inlet pipe in fluid communication with the exhaust pipe, the inlet pipe disposed within the interior wall and extending through the first end cap, through the first end plate, and through the plurality of baffles, a portion of the inlet pipe being perforated; and an outlet pipe disposed within the interior wall and extending through the second end cap, through the second end plate, and through the plurality of baffles, a portion of the outlet pipe being perforated.

18. The engine system of claim 17, wherein a second insulation material is disposed between the second end plate and the second end cap, and a third insulation material is disposed between the interior wall and the exterior wall.

19. The engine system of claim 18, wherein the first insulation material is comprised of fiberglass.

20. The engine system of claim 17, wherein a length of the inlet pipe and a length of the outlet pipe are equivalent, and the inlet pipe and outlet pipe are arranged parallel and planar to each other.

* * * * *